US011910854B2

(12) United States Patent
Delumpa

(10) Patent No.: US 11,910,854 B2
(45) Date of Patent: Feb. 27, 2024

(54) HOSPITAL GOWN WITH SLIT

(71) Applicant: Vincent Byron Delumpa, Carmel, IN (US)

(72) Inventor: Vincent Byron Delumpa, Carmel, IN (US)

( * ) Notice: Subject to any disclaimer, the term of this patent is extended or adjusted under 35 U.S.C. 154(b) by 5 days.

(21) Appl. No.: 17/387,150

(22) Filed: Jul. 28, 2021

(65) Prior Publication Data

US 2023/0034194 A1 Feb. 2, 2023

(51) Int. Cl.
*A41D 13/12* (2006.01)

(52) U.S. Cl.
CPC .... *A41D 13/1245* (2013.01); *A41D 2300/324* (2013.01)

(58) Field of Classification Search
CPC ..... A41D 13/1245; A41D 13/1236; A41D 13/129; A41D 13/1263; A41D 13/1281; A41D 1/215; A41D 2300/324; A41D 13/1254; A41D 13/1209; A41D 13/12; A41D 13/1272; A41D 2300/30; A41D 2300/32; A41D 2300/33; A41B 9/026
USPC ..... 2/104, 114, 405, 234, 79, 80, 83, 78.2
See application file for complete search history.

(56) References Cited

U.S. PATENT DOCUMENTS 621,761 A * 3/1899 Allen ..... A41B 9/06 2/113
660,843 A * 10/1900 Coyle ..... A41D 13/1236 2/104
778,014 A * 12/1904 Coyle ..... A41D 13/1236 2/104
1,063,362 A * 6/1913 Lewy ..... A41B 9/08 2/78.2
1,098,155 A * 5/1914 Knapp ..... A41D 1/215 2/104
1,161,439 A * 11/1915 Belotti ..... A41B 9/08 2/78.2
1,194,969 A * 8/1916 Dickson ..... A41B 9/08 2/78.2
1,250,464 A * 12/1917 Janes ..... A41D 1/215 2/104
1,489,046 A * 4/1924 Thompson ..... A41B 9/08 2/269
1,998,051 A * 4/1935 Gerber ..... A41D 13/1236 2/114
2,300,667 A * 11/1942 Guignion ..... A41B 9/08 2/265
2,345,186 A * 3/1944 Elkes ..... A41D 1/22 2/218
2,519,202 A * 8/1950 Slater ..... A41D 1/06 D2/742
4,106,122 A * 8/1978 Dodd ..... A41D 1/215 2/48
4,205,398 A * 6/1980 Blume ..... A41D 13/1236 2/114
4,280,228 A * 7/1981 Sulzmann ..... A41D 1/215 2/104

(Continued)

*Primary Examiner* — Amy Vanatta
(74) *Attorney, Agent, or Firm* — Brett A. Schenck

(57) ABSTRACT

A gown for a wearer is provided. The gown includes an abdomen covering portion. The abdomen covering portion includes an opening. The opening is configured to enable access to an abdomen of the wearer. The abdomen covering portion incudes one or more fasteners. The opening may be closed by the one or more fasteners.

7 Claims, 4 Drawing Sheets

(56) References Cited

U.S. PATENT DOCUMENTS

| | | | | | |
|---|---|---|---|---|---|
| 5,182,813 | A * | 2/1993 | Booze | A41D 1/215 | 2/104 |
| 5,274,852 | A * | 1/1994 | Hogan | A41D 13/1236 | 2/88 |
| 5,946,722 | A * | 9/1999 | Trautmann | A41D 13/1236 | 2/114 |
| 2006/0037124 | A1* | 2/2006 | Cho | A41D 13/1245 | 2/114 |
| 2008/0115253 | A1* | 5/2008 | Gorman | A41D 13/1236 | 2/84 |
| 2010/0095424 | A1* | 4/2010 | Grgich | A41D 1/215 | 2/104 |
| 2015/0040283 | A1* | 2/2015 | Moore | A41B 1/10 | 2/69 |
| 2016/0095366 | A1* | 4/2016 | Pruitt | A41D 13/1281 | 2/114 |
| 2019/0261707 | A1* | 8/2019 | Cain | A41D 13/1245 | |
| 2019/0364992 | A1* | 12/2019 | Thomas | A41D 13/1245 | |
| 2022/0095720 | A1* | 3/2022 | Zawadzki | A41D 13/1254 | |

* cited by examiner

HOSPITAL GOWN WITH SLIT

FIELD

This application relates to a hospital gown with slit.

BACKGROUND

A hospital gowns is generally a loose article of clothing that can be worn by a patient in a hospital. Hospital gowns worn by patients are configured to allow easy access by hospital personnel to examine the patient's body. Generally, the hospital gown is a one-piece clothing article that fits over the patient's body and may extend to the feet of the patient. Patients that wear hospital gowns may need to have their abdominal examined. However, this involves lifting up the bottom of the gown to do the abdominal examination. This can be both embarrassing for the patient and the person who examines the abdomen or other portion in the front of the body. Also, this may require the patient to be moved to lift up the bottom of the gown to do the abdominal examination. This is time consuming and uncomfortable for the patient.

Hospital gowns may benefit from improvements.

SUMMARY

In one aspect of the present invention, A gown for a wearer is provided. The gown includes an abdomen covering portion. The abdomen covering portion includes an opening. The opening is configured to enable access to an abdomen of the wearer. The abdomen covering portion incudes one or more fasteners, wherein the opening may be closed by the one or more fasteners.

Other aspects of the disclosed invention will become apparent from the following detailed description, the accompanying drawings and the appended claims.

DETAILED DESCRIPTION

It will be readily understood that the components of the embodiments as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, etc. In other instances, well-known structures, materials, or operations are not shown or described in detail to avoid obfuscation. The following description is intended only by way of example, and simply illustrates certain example embodiments.

Figure 1:
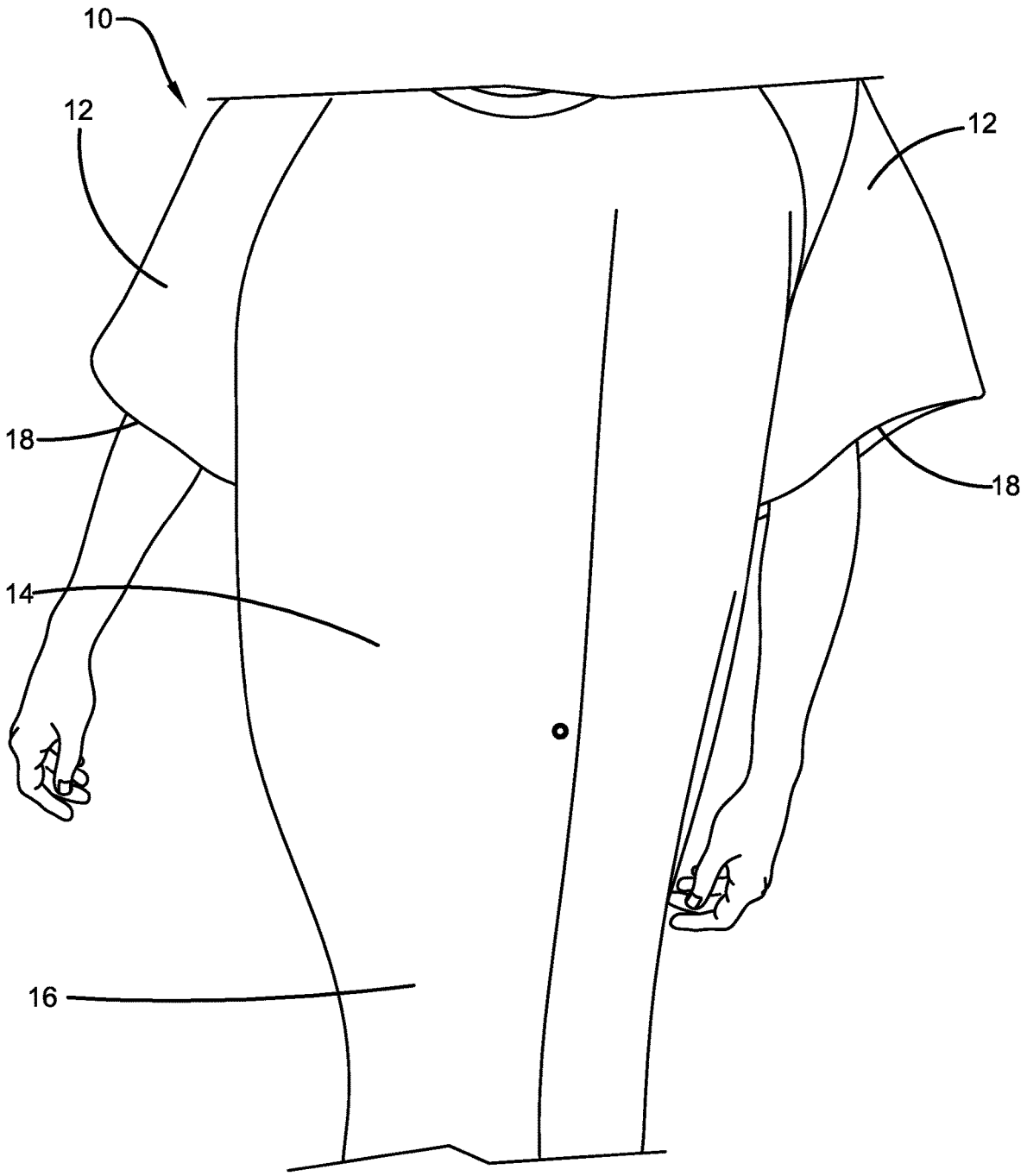
FIG. 1 is a front perspective view of the hospital gown worn on a wearer according to an embodiment of the invention.

Throughout the present description, the terms "upper", "lower", "top", "bottom", "left", "right", "front", "forward", "rear", and "rearward" shall define directions or orientations with respect to the hospital gown as illustrated in FIG. 1. It will be understood that the spatially relative terms "upper", "lower", "top", "bottom", "left", "right", "front", "forward", "rear", and "rearward" are intended to encompass different orientations of the hospital gown in use or operation in addition to the orientation depicted in the figures. For example, if the hospital gown in the figures is turned over, elements described as "upper" elements or features would then be "lower" elements or features.

Figure 4:
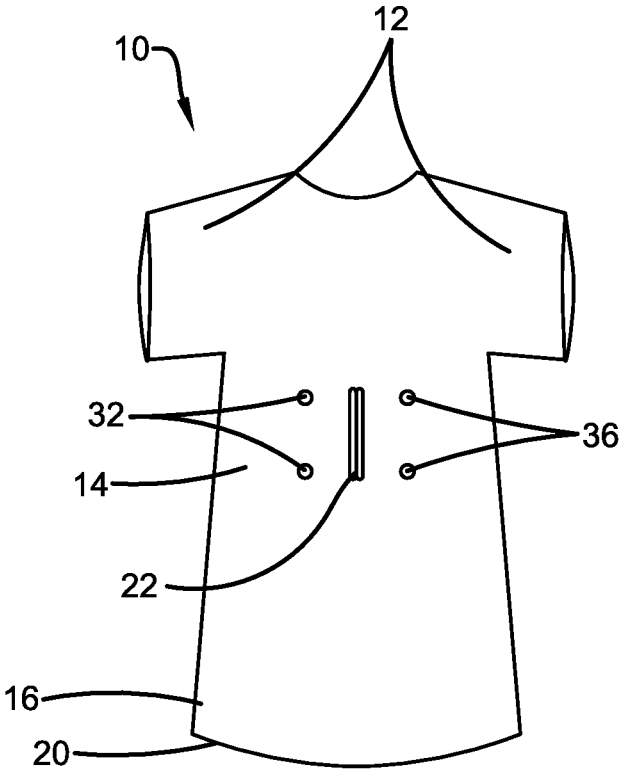
FIG. 4 is a front elevation view of the hospital gown of FIG. 1 with the slit being closed and including an additional fastener.
Figure 5:
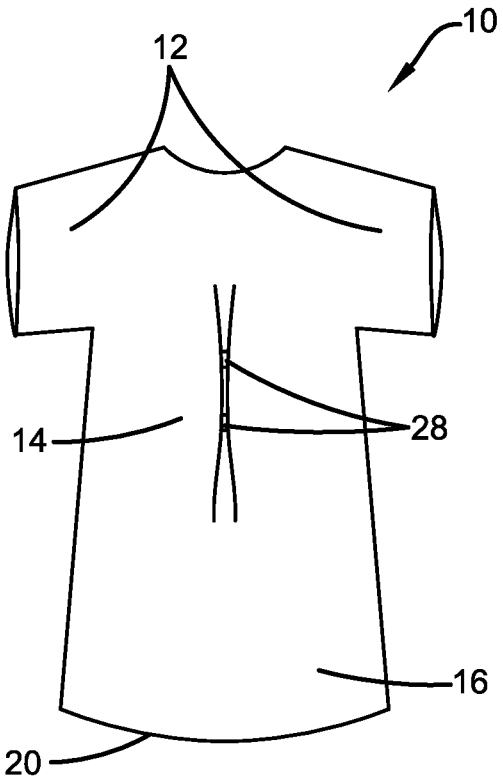
FIG. 5 is a front elevation view of the hospital gown of FIG. 4 with the slit being opened.

Referring to FIGS. 1, 4, and 5 a one-piece style hospital gown 10 is shown. It should be noted that other types of garments such as shirts may incorporate the features of the present invention. The hospital gown 10 is made of fabric and comprises upper shoulder portions 12, an abdomen covering portion 14, and a lower body covering portion 16. The upper shoulder portions 12 define arm openings 18 (FIG. 1). The lower body covering portion 16 has a bottom opening for the legs to pass through that is defined by a bottom end portion 20 (FIGS. 4 and 5).

Figure 2:
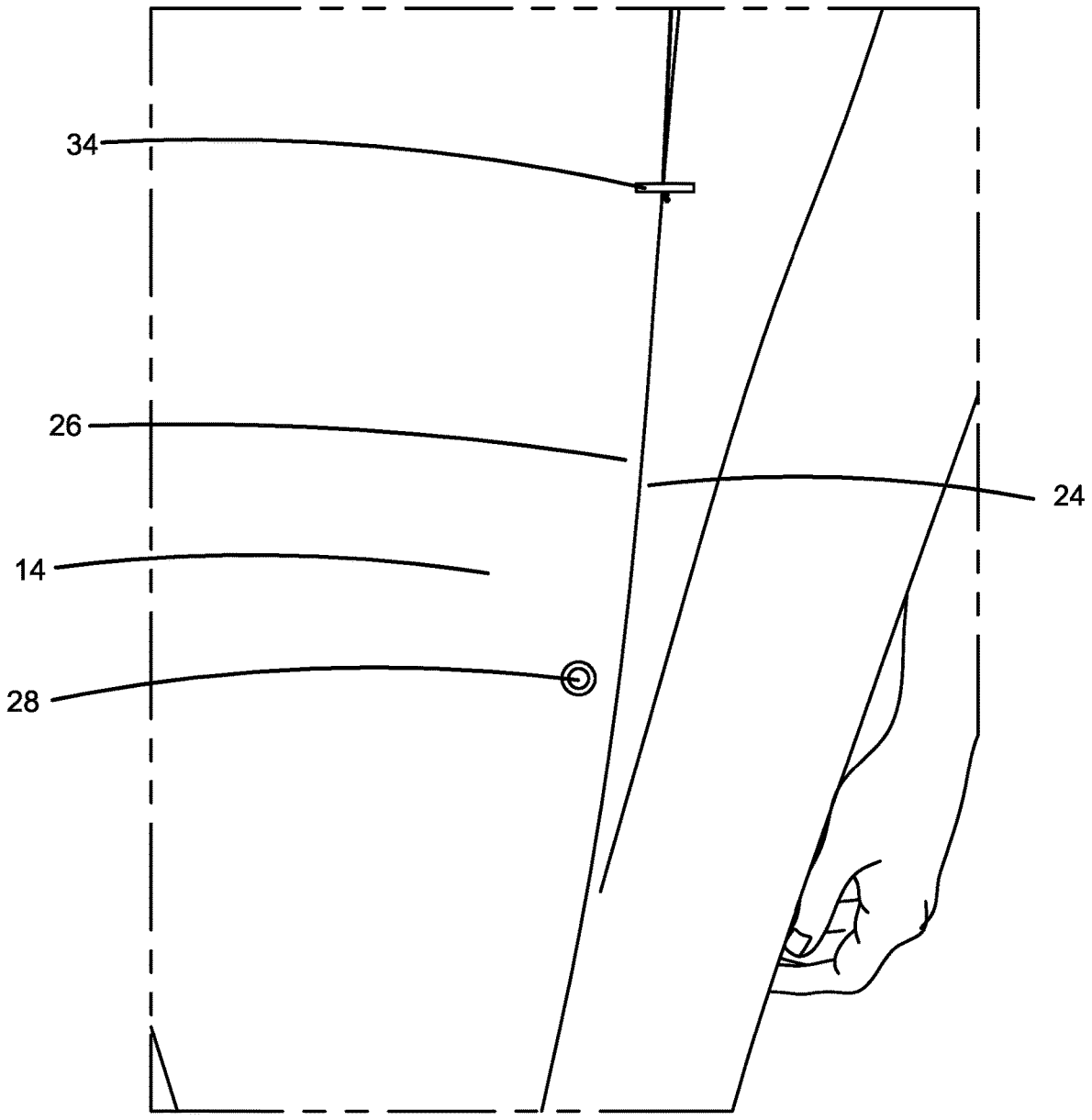
FIG. 2 is a front perspective view of the abdomen covering portion of the hospital gown of FIG. 1 worn on the wearer with the slit being closed.
Figure 3:
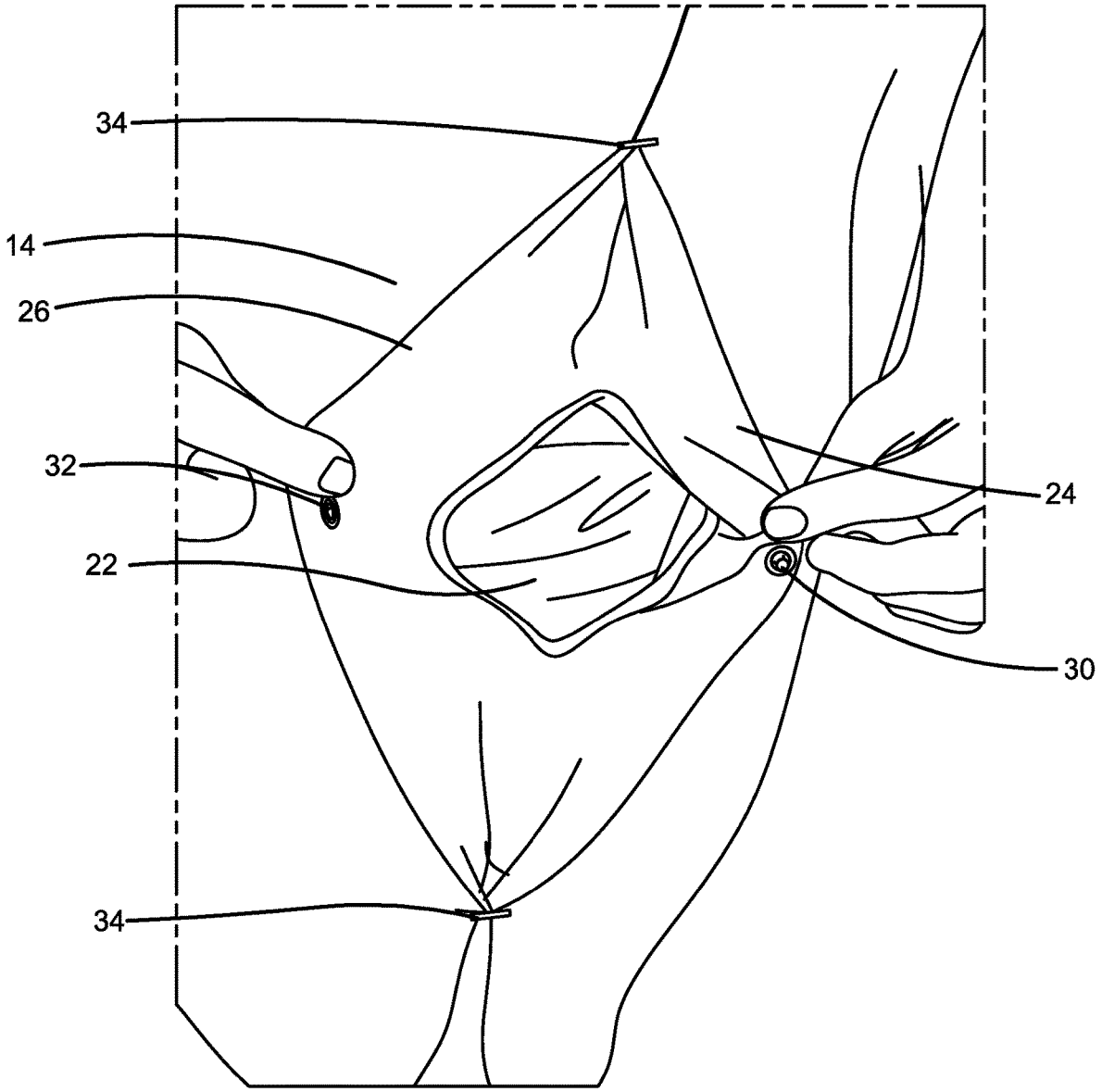
FIG. 3 is a front perspective view of the abdomen covering portion of the hospital gown of FIG. 1 worn on the wearer with the slit being opened.

As illustrated in FIGS. 3 and 4, the abdomen covering portion 14 has a slit 22 at the center of the abdomen covering portion 14. The slit 22 extends longitudinally. In particular, the slit 22 extends longitudinally between approximately the upper end of the abdomen covering portion 14 to the lower end of the abdomen covering portion 14. The slit 22 is located between right and left folded portions 24, 26 of fabric as depicted in FIG. 3. The slit 22 may be closed as shown in FIGS. 1, 2, and 5 and covered by the right and left folded portions 24, 26 folded over the slit 22 and fastened together by one or more fasteners 28. The fasteners 28 may be snaps, hooks and piles such as Velcro®, ties, a zipper, or other suitable fasteners. In this embodiment, FIG. 3 shows the fastener as being a snap 28. Alternatively, there may be two snaps 28 as shown in FIGS. 4 and 5. As seen in FIG. 3, a button portion 30 of the snap 28 is mounted on the right folded portion 24 and a socket portion 32 of the snap 28 for receiving the button portion 30 is mounted on the left folded portion 26. Alternatively, the button portion of the snap 28 may mounted on the left folded portion 26 and the socket portion 32 of the snap 28 may be mounted on the right folded portion 24. The right and left folded portions 24, 26 are also stitched to each other by stitches 34. One stitch 34 is located above the upper end of the slit 22 and another stitch 34 is located below the lower end of the slit 22. The slit 22 is shown as a being rectangular in shape. Alternatively, the slit can be any shape or sized opening such as circular and square. The slit may alternatively extend laterally and be opened and closed by fasteners on top and bottom folded portions. Alternatively, instead of providing the folded portions 24, 26 for covering the slit 22, other arrangements can be implemented to cover the slit 22 such as a fabric flap. As shown in FIGS. 1 and 3, the first and second stitches 34 secure the right folded portion 24 to the left folded portion 26 in an overlapping configuration such that the right folded portion 24 is maintained forwardly of the left folded portion 26 when the right and left folded portions 24, 26 are secured together by the one or more fasteners 28. As seen in FIG. 4, the entire slit 22 is positioned below the arm openings 18 and the length of the slit 22 is less than the length of each of the arm openings 18. As also depicted in FIG. 4, the length of the slit 22 is less than the distance between the lower end of the slit 22 and the bottom side of the gown 10, and the slit 22 is located loser to the top side of the gown 10 than the bottom side of the gown 10.

In operation, FIGS. 3 and 4 shows the gown 10 with the slit 22 being opened. To close the slit 22, a user grasps the right and left folded portions 24, 26 and places the button portion 30 on the socket portion 32 and presses the button portion 30 into the socket portion 32 to snap connect them together. When the user wants to gain access to the abdomen of the wearer of the gown 10, the user grasps the right and left folded portions 24, 26 and pulls them away from each other with sufficient force to unsnap and remove the button portion 30 from the socket portion 32. The user then opens the slit 22 as seen in FIG. 3 to allow access to the abdomen area of the wearer of the gown 10 for examination, treatment or other suitable purposes. The hospital gown 10 of the present invention thereby allows a person to conveniently gain access to the abdomen of the wearer of the gown 10 to examine the abdomen without lifting up the gown 10.

Although various embodiments of the disclosed hospital gown with slit have been shown and described, modifications may occur to those skilled in the art upon reading the specification. The present application includes such modifications and is limited only by the scope of the claims.

What is claimed is:

1. A gown for a wearer comprising:

upper shoulder portions, wherein the upper shoulder portions define arm openings; and an abdomen covering portion, wherein the abdomen covering portion comprises an opening, wherein the opening is configured to enable access to an abdomen of the wearer, wherein the opening is positioned along a front center of the gown in which the opening is centered between left and right front sides of the gown, wherein the opening is positioned along the front center of the gown in which the opening is positioned between top and bottom sides of the gown and is closer to the top side of the gown than the bottom side of the gown, wherein the abdomen covering portion incudes one or more fasteners, wherein the opening may be closed by the one or more fasteners, wherein the abdomen covering portion includes first and second folded portions, wherein the first and second folded portions are removably attached to each other by the one or more fasteners to close the opening, wherein the first folded portion is stitched to the second folded portion by a first stitch located at an upper end of the opening and a second stitch located at a lower end of the opening, wherein the opening extends longitudinally between the first and second stitches, wherein the first and second stitches secure the first folded portion to the second folded portion in an overlapping configuration such that the first folded portion is maintained forwardly of the second folded portion when the first and second folded portions are secured together by the one or more fasteners.

2. The gown of claim 1, wherein the one or more fasteners are one or more snaps.

3. The gown of claim 1, wherein the first and second folded portions are formed in one piece of fabric.

4. The gown of claim 1, wherein the length of the opening is less than the length of each of the arm openings.

5. The gown of claim 1, wherein the entire opening is positioned below the arm openings.

6. The gown of claim 1, wherein the length of the opening is less than the distance between the lower end of the opening and the bottom side of the gown.

7. The gown of claim 6, wherein the entire opening is positioned below the arm openings.

* * * * *